US009676603B1

(12) United States Patent
Oakley

(10) Patent No.: US 9,676,603 B1
(45) **Date of Patent: *Jun. 13, 2017**

(54) MULTIPURPOSE HANDHELD TOOL AND ASSOCIATED METHOD

(71) Applicant: Dennis C. Oakley, Waterford, NY (US)

(72) Inventor: Dennis C. Oakley, Waterford, NY (US)

( * ) Notice: Subject to any disclaimer, the term of this patent is extended or adjusted under 35 U.S.C. 154(b) by 302 days.

This patent is subject to a terminal disclaimer.

(21) Appl. No.: 14/543,192

(22) Filed: Nov. 17, 2014

Related U.S. Application Data

(63) Continuation-in-part of application No. 13/611,815, filed on Sep. 12, 2012, now Pat. No. 8,887,598, which is a continuation-in-part of application No. 29/431,210, filed on Sep. 5, 2012, now Pat. No. Des. 710,670.

(51) Int. Cl.
*B67B 7/44* (2006.01)
*B67B 7/04* (2006.01)

(52) U.S. Cl.
CPC ..... *B67B 7/44* (2013.01); *B67B 7/0423* (2013.01)

(58) Field of Classification Search
CPC ..... B67B 7/0423; B67B 7/0429; B67B 7/44; B67B 7/16; B67B 2007/0458
See application file for complete search history.

(56) References Cited

U.S. PATENT DOCUMENTS 1,845,038 A 2/1932 Alderson
1,953,690 A 4/1934 Samways
D297,210 S 8/1988 Liversidge
5,038,644 A 8/1991 Delsack
5,946,753 A 9/1999 Roberts et al.
D420,265 S 2/2000 Pierce
6,698,049 B2 3/2004 McLoudrey
D488,689 S 4/2004 Smith, IV
6,742,414 B1 * 6/2004 Brailsford ..... B67B 7/16 81/3.4
D501,381 S 2/2005 Kelleghan
D624,378 S 9/2010 Wysopal
D637,463 S 5/2011 Silvers et al.
D649,001 S 11/2011 Still
D654,770 S 2/2012 Frank et al.
D657,651 S 4/2012 Rubin et al.
8,281,437 B2 10/2012 Hunkele
D688,542 S 8/2013 Wysoczynski et al.
8,631,722 B1 * 1/2014 Davis ..... B25F 1/04 7/155
8,887,598 B1 * 11/2014 Oakley ..... B67B 7/44 7/155
9,107,543 B2 * 8/2015 Salles ..... A47J 43/27
2011/0072594 A1 3/2011 Danias-Borkin

* cited by examiner

*Primary Examiner* — David B Thomas
(74) *Attorney, Agent, or Firm* — Onello & Mello, LLP

(57) ABSTRACT

A multifunctional hand-operable beverage service tool includes a casing having a cavity defined therein, the casing having a proximal end region and a distal end region. A plurality of tools are pivotally coupled to said casing, the tools each being independently pivotable relative to the casing along an arcuate path defined between retracted and deployed positions; wherein one of said plurality of tools comprises a wine key lever. A first opening is positioned through the distal end region of the casing, the first opening being constructed and arranged to engage and remove a bottle cap. A second opening comprising a finger hole is positioned through the proximal end region of the casing.

20 Claims, 13 Drawing Sheets

MULTIPURPOSE HANDHELD TOOL AND ASSOCIATED METHOD

CROSS REFERENCE TO RELATED APPLICATIONS

This application is a continuation-in-part of U.S. Ser. No. 13/611,815, filed Sep. 12, 2012, now pending, the entire content of which is incorporated herein by reference, in its entirety.

This application is related to U.S. Design Pat. No. D7610670, the entire content of which is incorporated herein by reference, in its entirety.

This application is related to U.S. Pat. No. 8,015,642, issued Sep. 13, 2011, the entire content of which is incorporated herein by reference.

BACKGROUND

Technical Field

Inventive concepts relate to handheld tools and, more particularly, to a multipurpose handheld tool for providing a variety of implements, in one unit, that are typically used by professional bartenders.

Prior Art

Tending bar can be a fun and rewarding career. Whether pouring icy cold beers at the local tavern, blending coladas and daiquiris at a beach front resort, or serving cosmopolitans in a Manhattan nightclub, bartending can be an exciting way to meet new, interesting people and earn great money in the process. Most bartenders earn an hourly salary, plus receive generous tips from their customers. With today's standard tip being 20% of the customer's total bill, tending bar can indeed be a profitable career choice. In fact, many large bars and restaurants offer their bar staff full benefits and comprehensive insurance plans. Bartenders who work for major hotel chains and airlines also receive perks such as free lodging or reduced price airfare around the world. Additionally, many prefer working the evening hours that most bartending jobs afford and the ability to choose the bar or restaurant surroundings that best suit their individual personality.

As with many professionals, bartenders depend on a variety of implements when completing their work. Whether a wine knife utilized to remove the stiff foil seal from the top of a wine bottle, a flashlight used to illuminate a customer's bill, or a bottle opener designed to effortlessly flip the cap off a bottle of icy cold beer—there are countless tools utilized when bartending which must be readily available at all times.

Further, items such as a cigar cutter for use in nipping the end off a customer's cigar, or a pen to be lent to a couple who wishes to exchange phone numbers—bartenders must keep a wide array of implements on hand not only to execute bartending tasks, but also to keep customers happy in the process. Unfortunately, keeping these many tools and instruments neat and organized when on the job can be problematic. Stuffed into an apron pocket, various size openers, flashlights, pens and similar instruments can be extremely bulky and heavy. Placed in a storage drawer, items stored haphazardly can be difficult to locate when needed.

SUMMARY

Embodiments of the present inventive concepts overcome the above noted shortcomings. The multipurpose handheld tool is convenient and easy to use, lightweight yet durable in design, and designed for providing a variety of implements, in one unit, that are typically used by professional bartenders. The device is simple to use, inexpensive, and designed for many years of repeated use.

Embodiments provide an apparatus for a multifunctional hand-operable tool for use in restaurant environments, and an associated method.

In an aspect, a multifunctional hand-operable beverage service tool comprises: a casing having a proximal end region and a distal end region; a plurality of tools pivotally coupled to said casing, the tools each being independently pivotable relative to the casing along an arcuate path defined between retracted and deployed positions; wherein one of said plurality of tools comprises a wine key lever, the wine key lever comprising a zester at a distal end thereof, the zester including a plurality of openings, an outermost edge of the wine key lever including a sharpened surface proximal to the plurality of openings; a first opening through the distal end region of the casing, the first opening being constructed and arranged to engage and remove a bottle cap; and a second opening comprising a finger hole through the proximal end region of the casing.

In some embodiments, the plurality of openings comprises a number ranging between two and eight.

In some embodiments, the plurality of openings comprises four openings.

In some embodiments, inner surfaces of the openings are oriented perpendicular to upper and lower surfaces of the wine key lever.

In some embodiments, inner surfaces of the openings are oriented at an acute angle relative to upper and lower surfaces of the wine key lever.

In some embodiments, said wine key lever is constructed and arranged to comprise first and second leverage points that are fixed in position relative to each other.

In some embodiments, the finger hole comprises a rounded inner surface.

In some embodiments, the finger hole has an inner width of at least 1 inch.

In some embodiments, the finger hole is circular.

In some embodiments, the multifunctional tool further comprises a sleeve on an inner surface of the finger hole.

In some embodiments, the sleeve is on an entire inner surface of the finger hole.

In some embodiments, the sleeve is on a portion of the inner surface of the finger hole.

In some embodiments, the sleeve further covers a portion of at least one of an upper surface or a lower surface of the casing proximal to the finger hole.

In some embodiments, the sleeve further covers an outermost end of the casing proximal to the finger hole.

In some embodiments, the sleeve is constructed and arranged to rotate freely relative to the casing.

In another aspect, a multifunctional hand-operable beverage service tool comprises: a casing having a proximal end region and a distal end region; a plurality of tools pivotally coupled to said casing, the tools each being independently pivotable relative to the casing along an arcuate path defined between retracted and deployed positions; a first opening through the distal end region of the casing, the first opening being constructed and arranged to engage and remove a bottle cap; and a second opening comprising a finger hole through the proximal end region of the casing, a sleeve being positioned on an inner surface of the finger hole.

In some embodiments, the sleeve is on an entire inner surface of the finger hole or on a portion of the inner surface of the finger hole.

In some embodiments, the sleeve covers a portion of at least one of an upper surface or a lower surface of the casing proximal to the finger hole, or further covers an outermost end of the casing proximal to the finger hole.

In some embodiments, the sleeve is constructed and arranged to rotate freely relative to the casing.

In some embodiments, one of said plurality of tools comprises a wine key lever, the wine key lever comprising a zester at a distal end thereof, the zester including a plurality of openings, an outermost edge of the wine key lever including a sharpened surface proximal to the plurality of openings.

In another aspect, a multifunctional hand-operable beverage service tool comprises: a casing having a cavity defined therein, the casing having a proximal end region and a distal end region; a plurality of tools pivotally coupled to said casing, the tools each being independently pivotable relative to the casing along an arcuate path defined between retracted and deployed positions; wherein one of said plurality of tools comprises a wine key lever; a first opening through the distal end region of the casing, the first opening being constructed and arranged to engage and remove a bottle cap; and a second opening comprising a finger hole through the proximal end region of the casing.

In some embodiments, the finger hole comprises a rounded inner surface.

In some embodiments, the finger hole has an inner width of at least 1 inch.

In some embodiments, the finger hole is circular.

In some embodiments, the multifunctional tool further comprises a plurality of ridges on at least one of an upper and lower portion of an inner surface of the finger hole.

In some embodiments, the casing comprises anterior and posterior plates equidistantly spaced apart along a major longitudinal length of said casing such that a major portion of said cavity maintains a uniform outer thickness of the casing.

In some embodiments, the wine key lever is constructed and arranged to comprise first and second leverage points that are fixed in position relative to each other.

In some embodiments, the wine key lever further comprises a plurality of holes at a distal end region thereof, the holes including sharpened inner edges.

In some embodiments, the multifunctional tool further comprises a flashlight.

In some embodiments, the multifunctional tool further comprises a button switch for activating and deactivating the flashlight.

In some embodiments, the multifunctional tool further comprises a magnifying lens.

In some embodiments, the magnifying lens is retractable within the casing.

In some embodiments, the multifunctional tool further comprises a pen clip fixed at an outer portion of the casing.

In some embodiments, another of the plurality of tools pivotally coupled to said casing comprises a corkscrew.

In some embodiments, another of the plurality of tools pivotally coupled to said casing comprises a peeling tool.

In some embodiments, another of the plurality of tools pivotally coupled to said casing comprises a serrated cutting tool.

In some embodiments, another of the plurality of tools pivotally coupled to said casing comprises a can opener.

In some embodiments, the first opening comprises a concave curvilinear edge.

In some embodiments, the multifunctional tool further comprises a clock timer at an outer portion of the casing.

In some embodiments, the wine key lever remains exposed exterior of said casing while positioned at both said retracted and deployed positions.

In other aspect, a multifunctional hand-operable beverage service tool comprises a casing having a cavity defined therein, the casing having a proximal end region and a distal end region; and a plurality of tools pivotally coupled to said casing, the tools each being independently pivotable relative to the casing along an arcuate path defined between retracted and deployed positions, wherein one of said plurality of tools comprises a wine key lever; the wine key lever further comprising a plurality of holes at a distal end region thereof, the holes including sharpened inner edges.

In some embodiments, the multifunctional tool further comprises: a first opening through the distal end region of the casing, the first opening being constructed and arranged to engage and remove a bottle cap; and a second opening comprising a finger hole through the proximal end region of the casing.

In other aspects, the multifunctional hand-operable tool may include a casing having a cavity and a plurality of tools pivotally coupled to such a casing. Each of the tools may preferably be independently articulated along a unique arcuate path defined between retracted and deployed positions. One of such tools preferably has a bifurcated wine key lever having a first member and a second member resiliently biased along a fulcrum axis traversing along a longitudinal length of the wine key lever.

Such a wine key lever may preferably be configured in such a manner that the first and second members are aligned along a rectilinear path when pivoted to the retracted position. In this way, the wine key lever may remain exposed exterior of the casing while positioned at the retracted and deployed positions respectively. The second member may further be pivotally coupled directly to the casing with the first member remaining spaced from the casing while the wine key lever is biased to the deployed position. The wine key lever may further include first and second slots formed adjacent to conjoining edges of the first and second members respectively.

A band may preferably be positioned through the first and second slots and wrapped about the conjoining edges of the first and second members such that the band is deformably resilient, during operating conditions. The band is preferably configured in such a manner that a resistive force is exerted against the first member when the wine key lever is pivotally offset along the fulcrum axes. Such a fulcrum axis may preferably be defined along the conjoining edges of the first and second members respectively. The combination of such first and second members of the wine key lever provides an unpredictable and unexpected advantage of having a first and second leverage point for extraction of the cork from a wine bottle.

In one embodiment, the casing may include anterior and posterior plates equidistantly spaced apart along a major longitudinal length of the casing such that the cavity maintains a uniform thickness along the entire respective longitudinal lengths of the first and second members. In addition, the apparatus may further include first and second flange portions directly coupled to proximal and distal ends of the casing respectively such that each of the flange portions axially extends away from the casing and face axially opposed directions respectively.

The apparatus may further include a plurality of tools selected from a group of tools including: a wine knife preferably provided with a lemon skin peeler situated at the first flange portion; a serrated cutting utensil preferably situated adjacent to the proximal end and juxtaposed adjacent to the first flange portion; a corkscrew preferably situated adjacent to the wine key lever; and a can opener situated at the distal end of the casing and further juxtaposed adjacent to the second flange portion.

In one embodiment, the apparatus may include any combination of such tools as may be optimized for a user. In addition, the apparatus may further include a bottle cap popper preferably having a concave curvilinear edge. A clock may also be positioned at the proximal end of the casing.

In another embodiment, the apparatus may further include a rectilinear slot formed in the anterior face of the casing. An ink pen may be provided, which is removably positioned within the slot. The ink pen may preferably be countersunk within the slot while housed in a stored position. In this manner, the ink pen may be held securely in place within the slot and easily extracted by user when the need arises.

The apparatus may further include a retractable flashlight attached to the casing. Such a retractable flashlight preferably includes a body provided with a light-emitting source located at a distal end of the casing. The flashlight may preferably include a switch and a power source communicatively coupled thereto. In use, the body is automatically displaced to a deployed position when the switch is linearly biased along an axial path defined parallel to a longitudinal length of the casing. In this manner, the switch may be toggled to an open position while the body is at the deployed position and may further be toggled to a closed position while the body is linearly biased to a retracted position. This arrangement allows the user to easily turn the flashlight to an "on" or "off" position such as for example, with his/her thumb in a speedy and effortless manner.

The present inventive concepts may further include a method of utilizing a multifunctional hand-operable tool for use in restaurant environments. Such a method may include the chronological steps of: providing a casing having a cavity; providing a plurality of tools to the casing such that one of the tools may include a bifurcated wine key lever preferably having a first and a second member; and pivotally coupling the tools to the casing such that the wine key lever is pivotally coupled to the casing by pivotally coupling the second member directly to the casing.

The method may further include the chronological steps of: aligning the first and second members along a rectilinear path when pivoted to the retracted position; resiliently biasing the first and second members along a fulcrum axis by traversing a longitudinal length of the wine key lever; maintaining the first member spaced from the casing while the wine key lever is biased to the deployed position; and maintaining the wine key lever exposed exterior of the casing while positioned at the retracted and deployed positions respectively. The method may further include the step of: independently articulating each of the tools along a unique arcuate path defined between retracted and deployed positions.

There has thus been outlined, rather broadly, the more important features of the inventive concepts in order that the detailed description thereof that follows may be better understood, and in order that the present contribution to the art may be better appreciated. There are additional features of the inventive concepts that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the inventive concepts of the application, which is measured by the claims, nor is it intended to be limiting as to the scope of the inventive concepts in any way.

BRIEF DESCRIPTION OF THE SEVERAL VIEWS OF THE DRAWINGS

The novel features believed to be characteristic of the inventive concepts are set forth with particularity in the appended claims. The inventive concepts themselves, however, both as to their organization and methods of operation, together with further objects and advantages thereof, may best be understood by reference to the following description taken in connection with the accompanying drawings in which:

Figure 1:
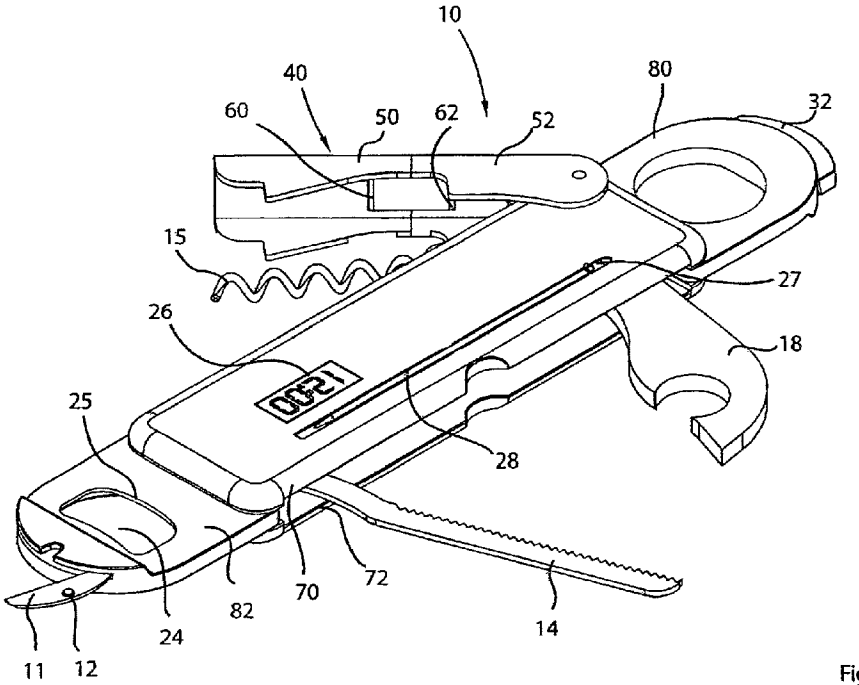
FIG. 1 is a perspective view of a multipurpose tool showing some of the tools at deployed positions, in accordance with embodiments of the present inventive concepts.
Figure 2:
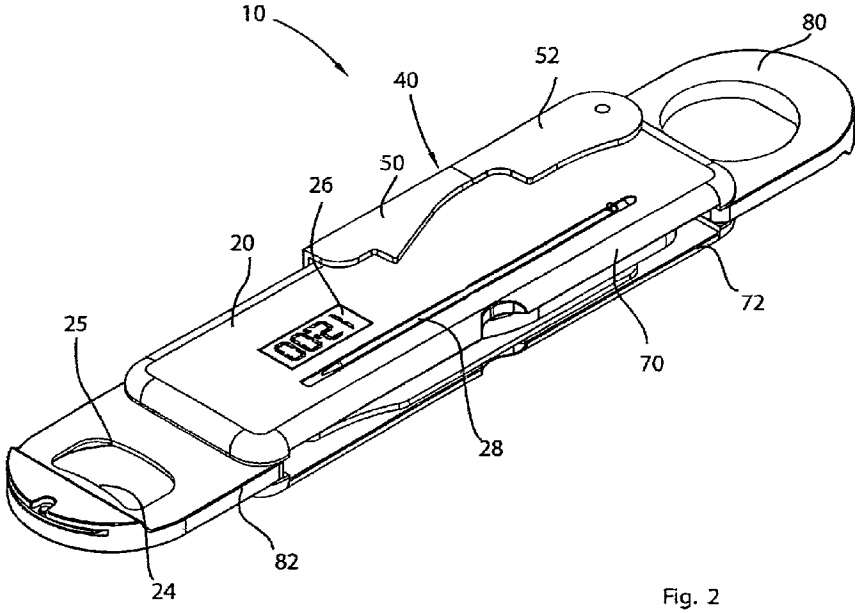
FIG. 2 is a perspective view of the multipurpose tool showing the tools in retracted positions.
Figure 3:
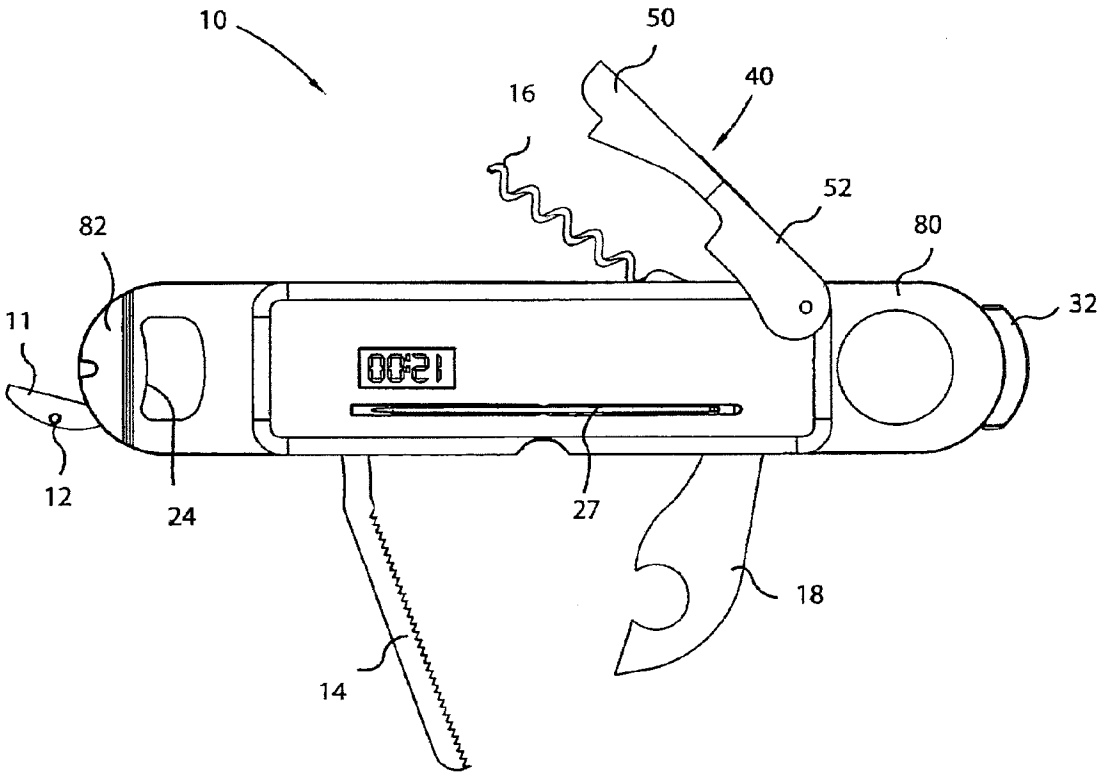
FIG. 3 is a top plan view of the multipurpose tool shown in FIG. 1.
Figure 4:
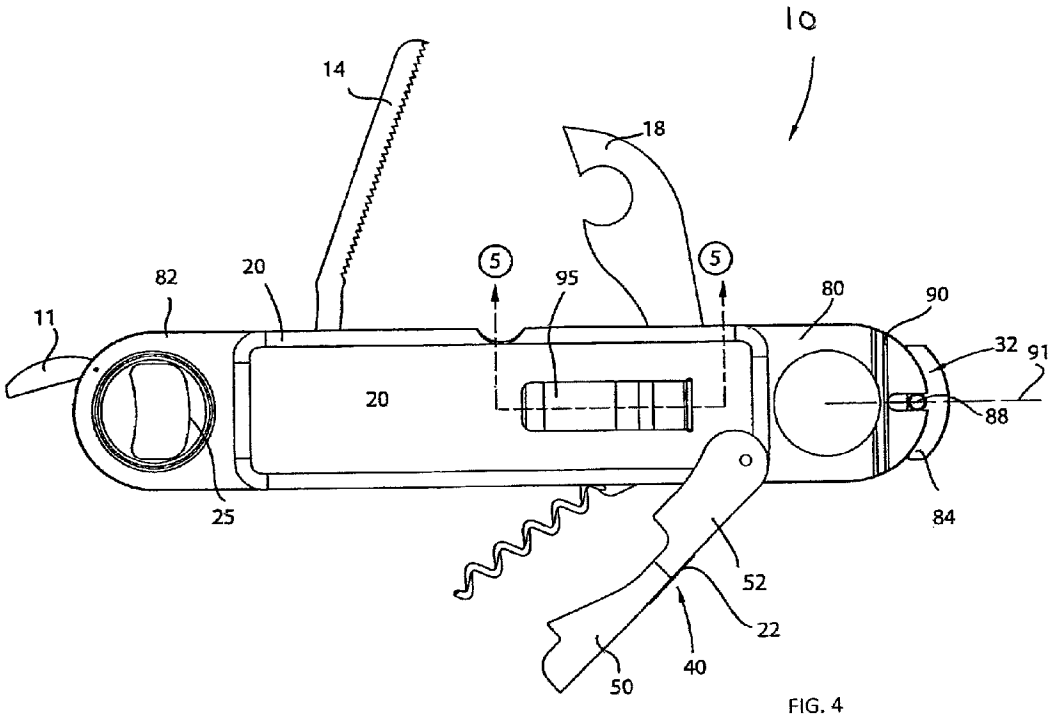
FIG. 4 is a bottom plan view of the multipurpose tool shown in FIG. 1.
Figure 5:
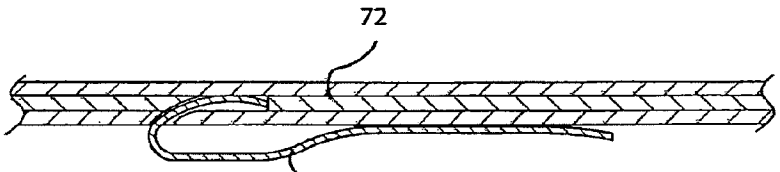
FIG. 5 is a cross-sectional view of a belt clip along line 5-5 in FIG. 4.
Figure 6:
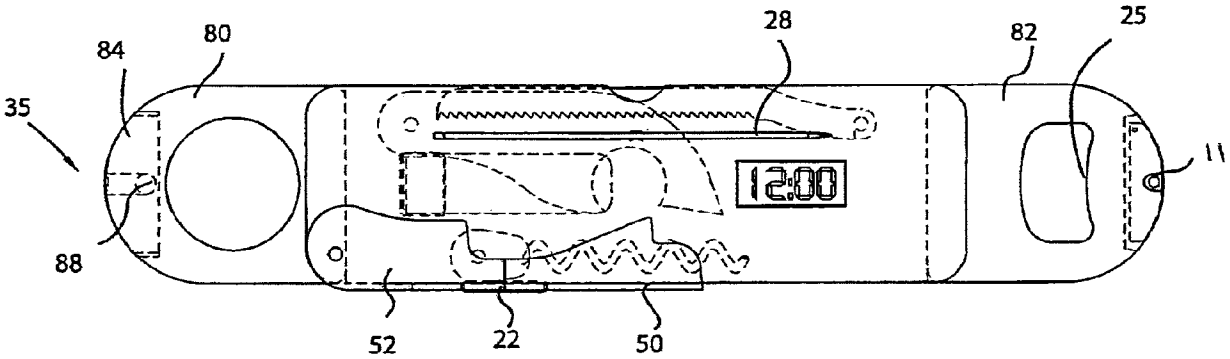
FIG. 6 is a top plan view of the multipurpose tool shown in FIG. 1.
Figure 7:
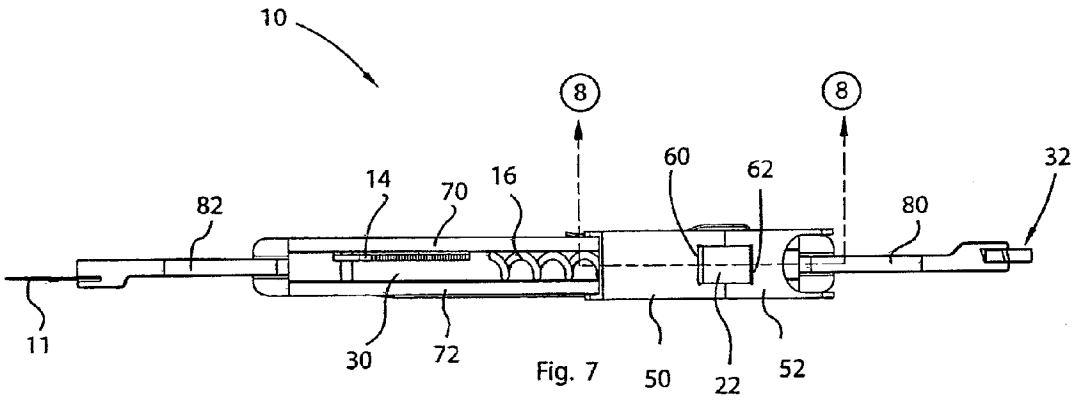
FIG. 7 is a side elevational view of the multipurpose tool shown in FIG. 1.
Figure 8:
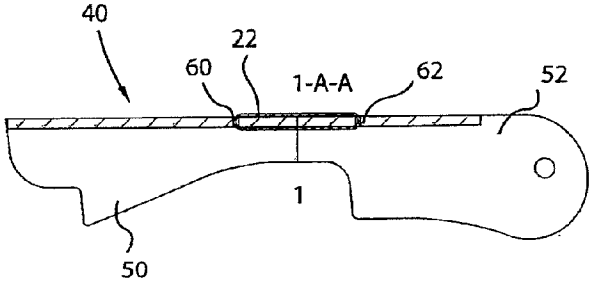
FIG. 8 is an enlarged cross-sectional view of the wine key lever along line 8-8 in FIG. 7.

Those skilled in the art will appreciate that the figures are not intended to be drawn to any particular scale; nor are the figures intended to illustrate embodiments of the inventive concepts. Embodiments are not limited to the exemplary embodiments depicted in the figures or the shapes, relative sizes or proportions shown in the figures.

DETAILED DESCRIPTION

Embodiments will now be described more fully hereinafter with reference to the accompanying drawings in which embodiments of the inventive concepts are shown. The inventive concepts may, however, be embodied in many different forms and should not be construed as limited to the embodiments set forth herein. Rather, embodiments are provided so that this application will be thorough and complete, and will fully convey the true scope of the inventive concepts to those skilled in the art. Like numbers refer to like elements throughout the figures.

A multifunctional hand-operable tool is referred to generally in FIGS. 1-8 by the reference numeral 10 and is intended to provide a multifunctional hand-operable tool for use in a restaurant environment. It should be understood that inventive concepts are not limited to use in restaurant environments only but may also be useful in a variety of other environments such as at home, parties and during outdoor cook outs where the multifunctional capabilities of this inventive concepts can be put to good use.

The multifunctional hand-operable tool may preferably include a casing 20 having a cavity 30 (FIG. 7) and a plurality of tools (identified hereinbelow) pivotally coupled to such a casing 20. Each of the tools may be independently articulated along a unique arcuate path defined between retracted and deployed positions. It is noted that each arcuate path is defined about a pivot point at which each tool is pivotally connected to the casing, for example.

One of such tools may include a bifurcated wine key lever 40 having a first member 50 and a second member 52 resiliently biased along a fulcrum axis A-A (FIG. 8), traversing along a longitudinal length of the wine key lever 40. Such a wine key lever 40 may be configured in such a manner that the first member 50 and the second member 52 are aligned along a rectilinear path when pivoted to the retracted position, as perhaps best shown in FIGS. 2 and 6-8. In this manner, the wine key lever 40 may remain exposed exterior of the casing 20 while positioned at the retracted and deployed positions respectively, as perhaps best shown in FIGS. 1-7.

The second member 52 may further be pivotally coupled directly to the casing 20, with the first member 50 remaining spaced from the casing 20 while the wine key lever 40 is biased to the deployed position. The wine key lever 40 may further include a first slot 60 and a second slot 62 formed adjacent to conjoining edges of the first member 50 and second member 52 respectively.

A band 22 may be positioned through the first and second slots 60, 62 and wrapped about the conjoining edges of the first and second members 50, 52 such that the band 22 is deformably resilient when the wine key lever 40 is pivoted about axis A-A. The band 22 is preferably configured in such a manner that a resistive force is exerted against the first member 50 when the wine key lever 40 is pivotally offset along the fulcrum axis. As perhaps best shown in FIG. 8, such a fulcrum axis A-A may preferably be defined along the conjoining edges of the first member 50 and second member 52, respectively. The combination of such first and second members 50, 52 of the wine key lever 40 provides an added advantage of having first and second leverage points for extracting a cork from a wine bottle.

Figure 9:
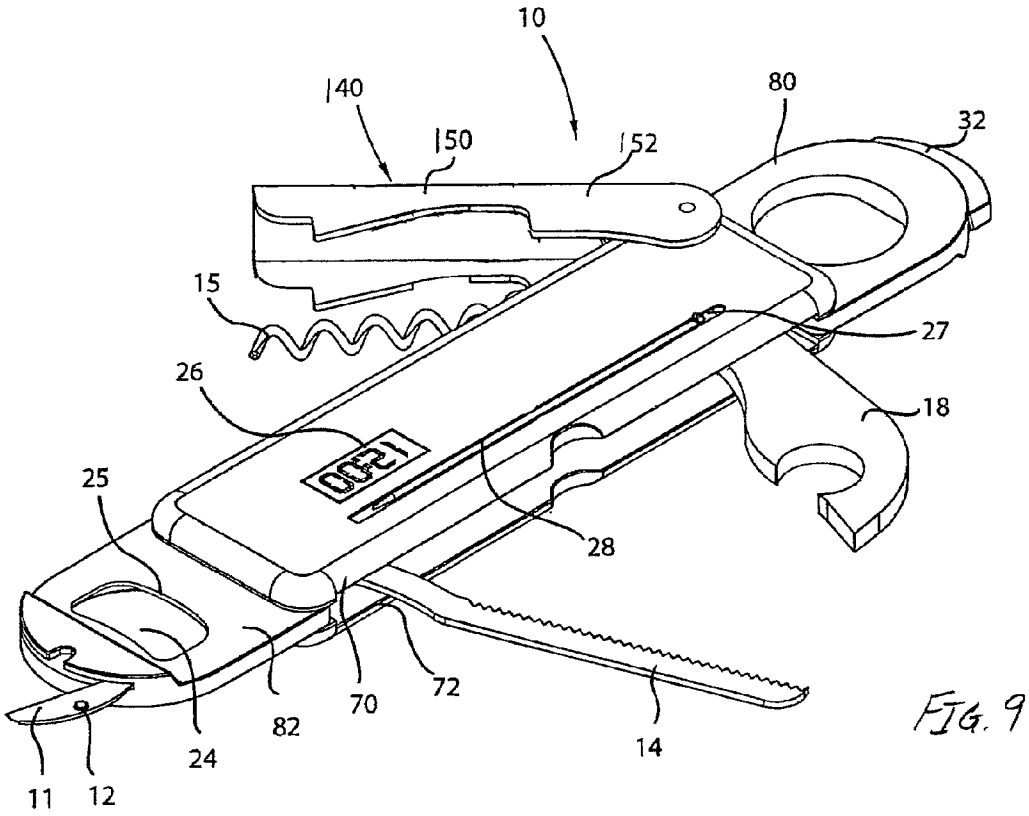
FIG. 9 is a perspective view of a multipurpose tool including a unitary wine key lever, in accordance with embodiments of the present inventive concepts.

In other embodiments, as shown in FIG. 9, the wine key lever 140 can comprise a unitary member that is pivotally coupled directly to the casing 20. In such embodiments, the wine key lever comprises a single, unitary lever 140 positioned relative to the casing 20 and corkscrew 15 suitably for interacting with the corkscrew 15 to effect a cork removal. In such embodiments, the wine key lever 140 does not include first and second members that articulate relative to one another; rather, the wine key lever 40 includes first and second portions 150, 152 that are fixed relative to one another and do not articulate relative to one another.

In one embodiment, the casing 20 may include anterior 70 and posterior plates 72 equidistantly spaced apart along a major longitudinal length of the casing 20 such that the cavity 30 (FIG. 7) preferably maintains a uniform thickness along the entire respective longitudinal lengths of the anterior and posterior plates 70, 72. In addition, the apparatus 10 may further include a first flange portion 80 and a second flange portion 82 directly coupled to proximal and distal ends of the casing 20, respectively, such that each of the flange portions 80, 82 axially extends away from the casing 20 and faces axially opposed directions respectively.

In one embodiment, the tools may be selected from a group of tools including: a wine knife 11 provided with a lemon skin peeler 12 situated at the first flange 82 portion; a serrated cutting utensil 14 preferably situated adjacent to the proximal end and juxtaposed adjacent to the first flange 82 portion; a corkscrew 16 preferably situated adjacent to the wine key lever 40; and a can opener 18 situated at the distal end of the casing 20 and further juxtaposed adjacent to the second flange 80 portion. A belt clip 95 is also provided as being mated to the posterior face 72 of the casing 20. In some embodiments, the belt clip 95 is removable from the casing, to allow for the option of removal for those users that prefer a sleeker configuration. In some embodiments, the belt clip is removably attached to the casing 20 by machine screws.

The lemon skin peeler 12 produces a lemon-twist garnish by concentrically dragging the lemon twist peeler/hole along a continuous and revolving surface of the lemon. The belt clip 95 allows the user to easily and quickly attach the casing 20 to a belt for convenient access. Of course, casing 20 may also be stored in a shirt or pants pocket, as needed.

Of course, any combination of such tools may be employed as desired by the user. In addition, the apparatus 10 may further include a bottle cap popper 24 preferably having a concave curvilinear edge 25. The curvilinear edge 25 is suitably sized and shaped for contiguously abutting an arcuate edge of a conventional bottle cap. Such contiguous abutment maximizes the surface area contact between edge 25 and the bottle cap and thereby ensures adequate contact points are maintained between edge 25 and the bottle cap. In this manner, more leverage is obtained when a user pops open a bottle of beer, for example. In one embodiment, a clock 26 may be positioned at the proximal end of the casing 20. In one embodiment, the posterior face of casing 20 include a reflective or polished "mirror" surface for assisting the user to quickly groom his/her hair in a stealthy manner.

In one embodiment, the apparatus 10 may further include a rectilinear slot 27 formed in an anterior face of the casing 20. A writing utensil, such an ink pen 28, may be removably positioned within the slot 27. The ink pen 28 may preferably be countersunk within the slot 27 while housed in a stored position. In this manner, the ink pen 28 may be securely held in place within the slot 27 while being easily extracted by user when the need arises.

The apparatus 10 may further include a retractable flashlight 32 attached to the casing 20. Such a retractable flashlight 32 preferably includes a body 84 provided with a light-emitting source located at a distal end of the casing 20. The flashlight 32 may preferably include a switch 88 and a power source 90 communicatively coupled thereto such that the body 84 is automatically displaced to a deployed position when the switch 88 is linearly biased along an axial path (91) defined parallel to a longitudinal length of the casing 20. In this manner, the switch 88 may be toggled to an open position when the body 84 is at the deployed position and may further be toggled to a closed position so that the body 84 is linearly biased to a retracted position. This arrangement allows the user to easily turn the flashlight 32 to an "on" or "off" position such as for example, with his/her thumb in a speedy and effortless manner.

Embodiments may further include a method of utilizing a multifunctional hand-operable tool for use in restaurant environments. Such a method may include the chronological steps of: providing a casing 20 having a cavity 30; providing a plurality of tools to the casing 20. One of such tools may include a bifurcated wine key lever 40 preferably having a first member 50 and a second member 52.

The method may further include the chronological steps of: pivotally coupling the tools to the casing 20. In particular, such a step may include pivotally coupling the wine key lever 40 to the casing 20 by pivotally coupling the second member directly to the casing 20.

The method may further include the chronological steps of: aligning the first 50 member and a second member 52 of the wine key lever 40 along a rectilinear path when pivoted to the retracted position; resiliently biasing the first member 50 and a second member 52 along a fulcrum axis A-A, by traversing a longitudinal length of the wine key lever; maintaining the first member spaced from the casing 20, while the wine key lever 40 is biased to the deployed position; and maintaining the wine key lever 40 exposed exterior of the casing 20 while positioned at the retracted and deployed positions, respectively. The method may further include the step of independently articulating each of the tools along a unique arcuate path defined between retracted and deployed positions.

The present inventive concepts, as claimed provides the unexpected and unpredicted benefit of organizing a multiplicity of bartender tools into a compact and sleek unit which provides an unpredictable and unexpected efficient, safe and speedy utility in a fast paced and dark environment such as a nightclub or restaurant. The combination of such claimed elements is not rendered obvious by one skilled in the art because the multifunctional tool would provide bartenders all the implements needed on the job thereby eliminating the need to stuff one's pockets with bottle openers, corkscrews, pens and flashlights, for example. The device will ensure all of these items are easily accessed with one tool, whether opening a bottle of wine, popping the cap off an icy cold bottle of beer, or signing one's name on a bar tab, the multipurpose handheld tool would ensure that one would never have to dig through pockets or search through crowded storage drawers in order to complete a designated task such increasing the productivity of users.

Compact in design and lightweight, the device could be easily secured to any keychain, tucked in a pocket or placed right on the bar, taking little storage space. Boasting a plethora of quality tools, the device is a versatile product which would serve a wide variety of useful applications. Enabling the bartender to focus their attention on the customer, the multipurpose handheld tool will serve to improve bartender/customer relations, resulting in happier clientele and increased tips. Ideal for use by bartenders, professional servers such as waitresses, busers and hosts, will appreciate the many benefits this useful product. Durably constructed, this cleverly designed tool should withstand years of repeated use.

Figures 10, 10A:
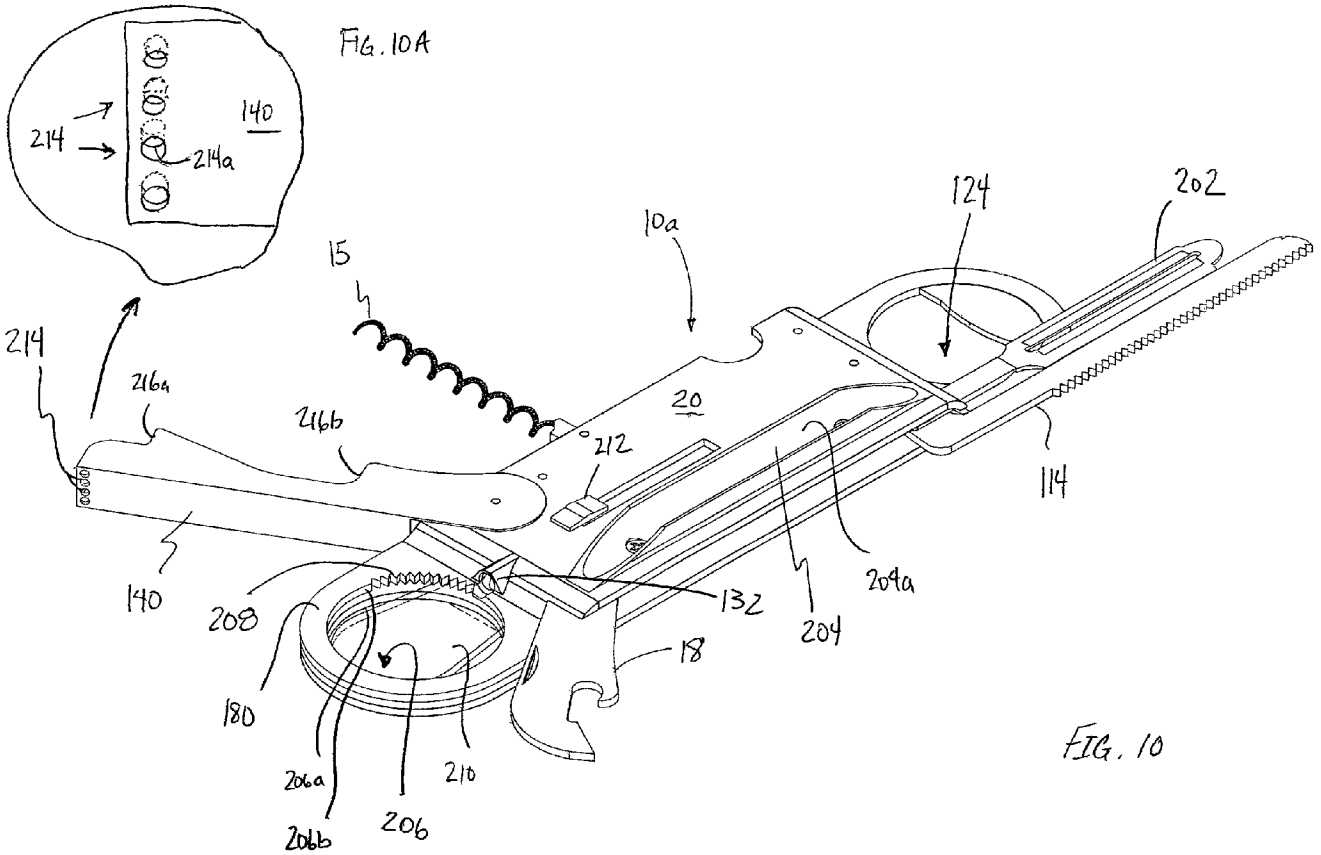
FIG. 10 is a perspective view of a multipurpose tool, in accordance with embodiments of the present inventive concepts.
FIG. 10A is a close-up view of an embodiment of a zester feature positioned at a distal end of a wine key lever, in accordance with embodiments of the present inventive concepts.

Referring to FIG. 10, a perspective view of a multipurpose tool 10*a*, in accordance with embodiments of the present inventive concepts, is depicted.

In this example embodiment, a unitary wine key lever 140 is shown, in accordance with the wine key lever 140 embodiment described above in connection with FIG. 9. The wine key lever 140 is customarily constructed and arranged to include first and second leverage points 216*a*, 216*b* to allow for proper extraction of a cork with minimal leverage.

A plurality of zester holes 214 are included at a distal end of the unitary wine key lever 140. Referring to the close-up view of FIG. 10A, the zester holes 214 can have longitudinal axes that lie at an acute angle relative to upper and lower surfaces of the wine key lever 140 so as to form sharp edge 214*a* at each zester hole that can be used as a citrus zester. Such zester holes 214 can be applied to any of the embodiments depicted herein.

A finger hole 206 is also included at a first end of the tool 10*a*. In some embodiments, the finger hole 206 comprises a rounded opening that extends through the body of the first flange portion 180. In some embodiments, the rounded opening of the finger hole 206 comprises a circular or oval opening. In some embodiments, the rounded opening of the finger hole 206 comprises a geometric-shaped opening such as a multiple-sided opening, such as a square, hexagon, octagon, with rounded corners. The finger hole 206 can be sized to allow for a user to insert a finger through the opening in a secure fashion. In some embodiments, the finger hole is at least 1 inch in width or, in the case of a circular finger hole, at least one inch in diameter.

The finger hole 206 can serve multiple functions for the multipurpose tool 10*a*. For example, the finger hole 206 can operate as a finger handle for a user to quickly retrieve the multipurpose tool 10*a* from a pocket, or to return the multipurpose tool to a clothes pocket. The inner walls of the finger hole 206 are rounded to permit a user to quickly flip the tool in his/her hand, about the finger, to allow for expeditious repositioning of the multipurpose tool in the hand. The finger hole 206 further provides an additional leverage point for the user operating any of the various tools associated with the multipurpose tool.

In some embodiments, the finger hole 206 includes a series of ridges 208 about at least a portion of the inner portion thereof. In some embodiments, the ridges 208 are present on at least one of an upper and lower edge surfaces 206*a*, 206*b* of the finger hole 206. In some embodiments, the ridges are serrated. In some embodiments, the ridges 208 are present on less than half of the inner perimeter of the finger hole, or on less than 180 degrees of the finger hole. In some embodiments, the ridges 208 are present on less than one-quarter of the inner perimeter of the finger hole, or on less than 90 degrees of the finger hole.

The finger hole 206 can be placed about the corkscrew region of a bottle of wine and the ridges 208 can be ground against the corkscrew foil, to assist a user in removing the corkscrew foil from the bottle of wine. Such a finger hole 206 can be applied to any of the embodiments depicted herein.

Further, in this embodiment, a magnifying lens 210 is housed within the body of the casing 20. The magnifying lens 210 can be fully retracted into the casing 20 in a first position and extended into the finger hole by a thumb lever 212 coupled to the magnifying lens. In various embodiments, the magnifying lens can comprise a plastic or glass material, or other suitable material, that is transparent to light and that provides a magnifying effect. Such a magnifying lens can be applied to any of the embodiments depicted herein.

Further, in this embodiment, the flashlight 132 is shown as being positioned at a proximal end of the casing 120, between the finger hole 206 and the casing 120. Such a flashlight position can be applied to any of the embodiments depicted herein. In various embodiments, the flashlight 132 may be activated by a button switch, a toggle switch. In other embodiments, the flashlight may be activated by an accelerometer-type switch so that a proper flick of the tool by the user can cause the light to turn on/off. In some embodiments, the flashlight 132 comprises a light source such as an LED coupled to a power source, such as a battery. Such a flashlight can be applied to any of the embodiments depicted herein.

Further, in this embodiment, a retractable fruit peeler 202 is rotatably attached to the casing 20. The fruit peeler can be handy to a user for peeling various fruits and vegetables prior to their inclusion in drink to be served to a patron. Such a fruit peeler can be applied to any of the embodiments depicted herein.

Further, in this embodiment, a pen clip 204 is fixedly attached to the outer portion of the casing. The pen clip 204 can be generally U-shaped in profile and have inner walls that flex relative to one another and are spaced apart from one another by a distance so as to receive a sidewall or body of a standard-sized pen. The pen clip 204 can be a single, elongated piece as shown, or can comprise two or more pieces spaced apart by a suitable distance on the body of the casing 20. In some embodiments, the pen clip is removable from the casing, to allow for the option of removal for those users that prefer a sleeker configuration. In some embodiments, the pen clip is removably attached to the casing 20 by machine screws. Such a pen clip 204 can be applied to any of the embodiments depicted herein.

Further, in this embodiment, the bottle opener hole 124 includes an inner edge that is concave and curvilinear in shape, which enables greater contact for leveraging the serrated edge points of the bottle cap to which the tool is applied and engaged.

Figures 11A, 11B:
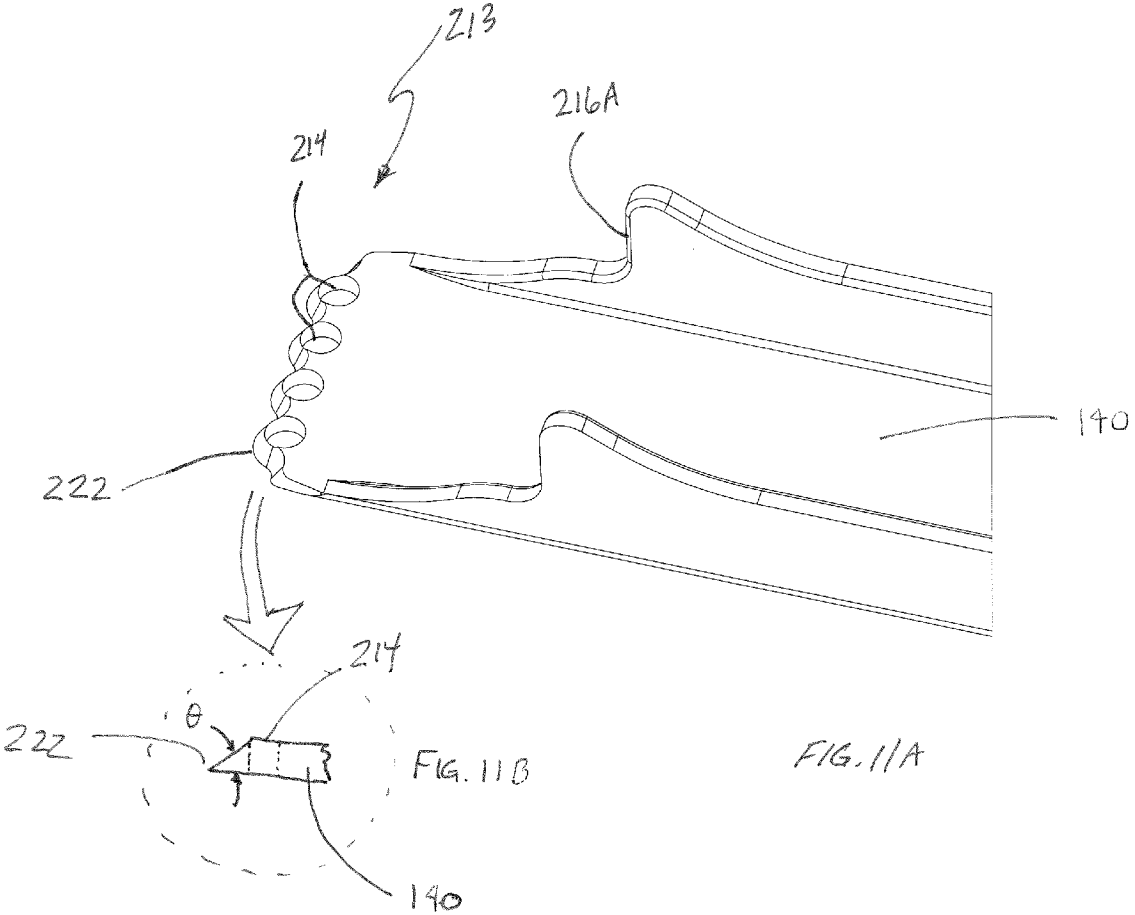
FIGS. 11A and 11B are close-up perspective and side views of an embodiment of a wine key lever including a zester further including a plurality of zester holes, in accordance with embodiments of the present inventive concepts.

FIGS. 11A and 11B are close-up perspective and side views of an embodiment of a wine key lever 140 including a zester 213 further including a plurality of zester holes 214, in accordance with embodiments of the present inventive concepts. Referring to FIGS. 11A and 11B, the wine key lever 140 includes a leverage point 216, as described herein. In the present embodiment, a plurality of zester holes 214 are included at a distal end of the wine key lever 140. Further, in the present embodiment, the outermost edge 222 of the wine key lever 140 is beveled or sharpened. This sharpened outermost edge 222 operates as a mechanism for puncturing the skin of a lime, lemon, orange, or other fruit to be zested by the zester 213. The punctured skin is then pulled through the zester holes 214 to create individual zest peels. In some embodiments, the outermost edge is sharpened to an angle θ. In some embodiments, the angle θ can range between 10 and 80 degrees. In some embodiments, the outermost edge 222 is contoured in plan view, as shown in FIGS. 11A and 11B, to match the contours of the openings 214.

In some embodiments a plurality of openings 214 can be provided. In some embodiments, the number of openings 214 can range between two and eight. In some embodiments, the number of openings 214 can be four. In some embodiments, the inner sidewalls of the openings 214 can be perpendicular to the planar upper and lower surfaces of the wine key lever 140, as shown in FIG. 11. In some embodiments, the inner sidewalls of the openings 21 can lie at an acute angle relative of the upper and lower surfaces of the wine key lever 140, as described herein in connection with FIG. 10A.

Figure 12:
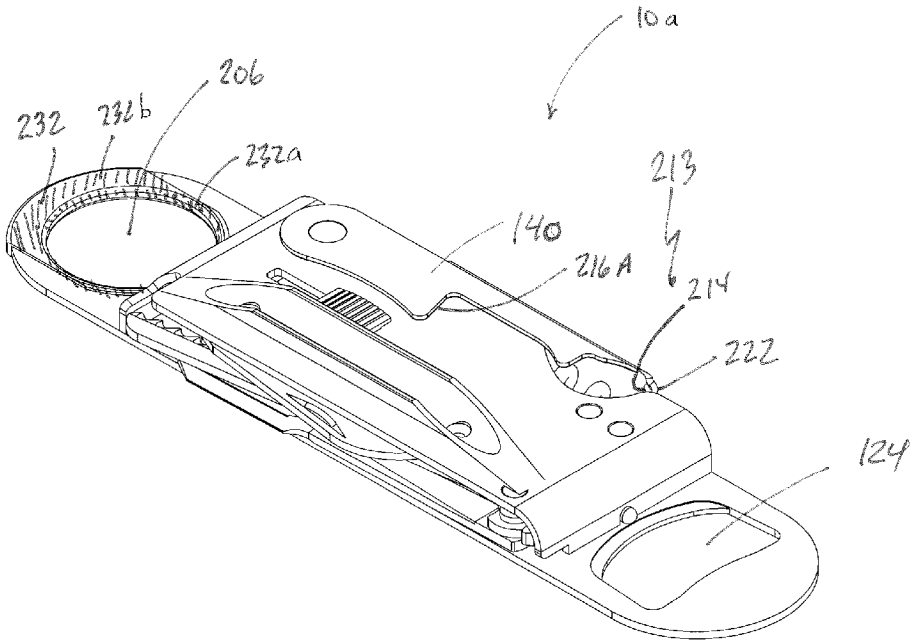
FIGS. 12, 13, and 14 are perspective views
Figure 13:
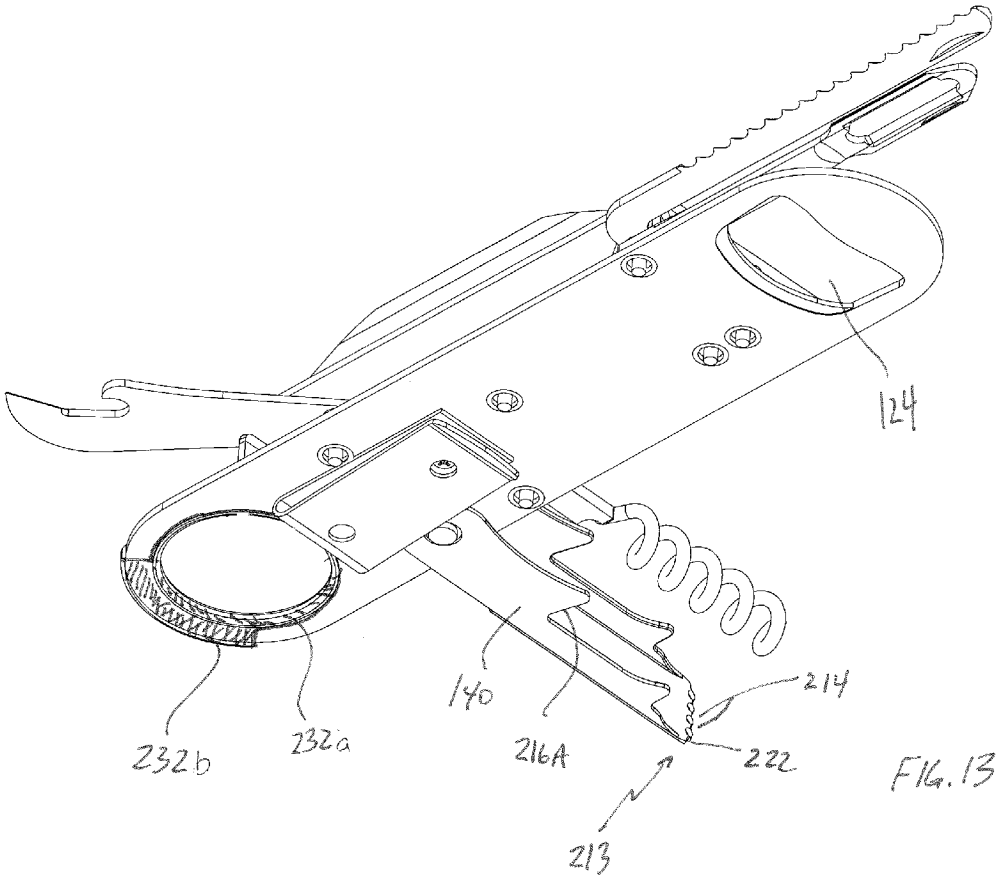
Figure 14:
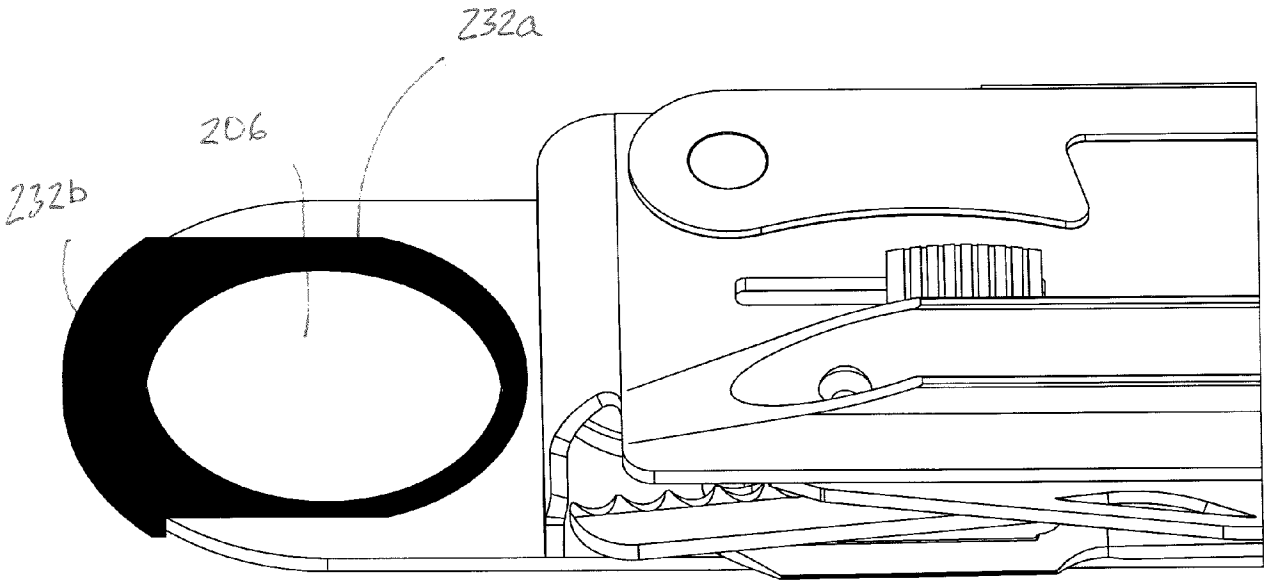
Figure 15:
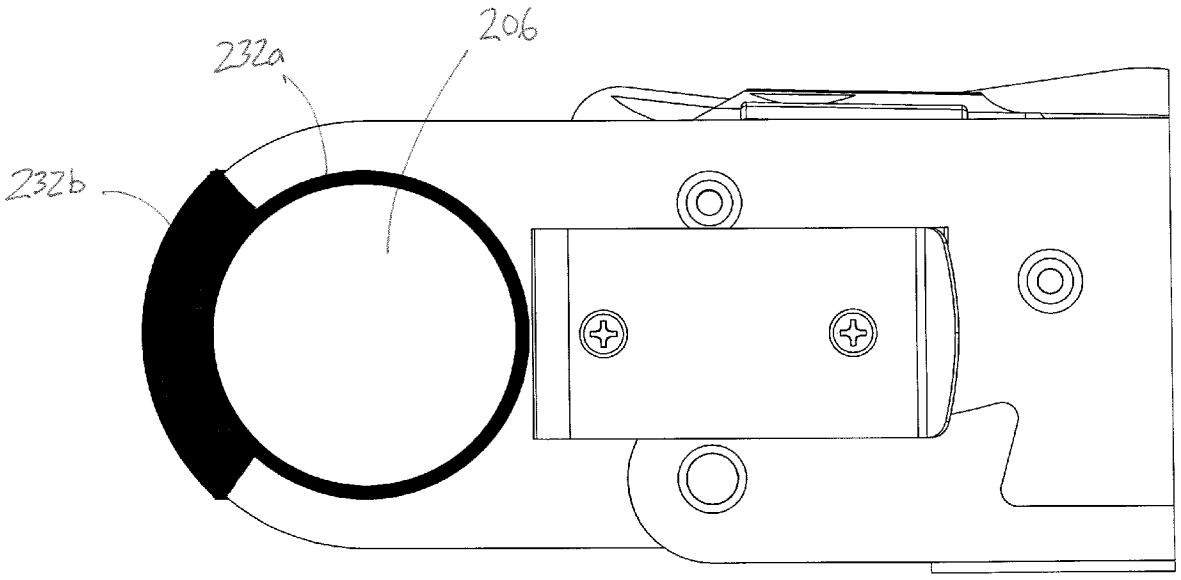
FIG. 15 is a top view of a multipurpose tool in accordance with embodiments of the present inventive concepts.

FIGS. 12, 13, and 14 are perspective views and FIG. 15 is a top view of a multipurpose tool 10*a* in accordance with embodiments of the present inventive concepts. Referring to FIGS. 12-15, in the present embodiment, the finger hole 206 includes a sleeve 232 on its inner surface. In some embodiments, the sleeve 232 comprises a coating that covers an inner surface of the finger hole 206 at a first portion 232*a* thereof and extends to cover at least a portion of the upper and/or lower surfaces of the multipurpose tool 10*a* in the region of the finger hole in a second portion 232*b* thereof.

In some embodiments, the first portion 232*a* covers an entire inner surface of the perimeter of the finger hole 206. In some embodiments, the first portion 232*a* covers a portion of the inner surface of the perimeter of the finger hole 206.

In some embodiments, the second portion 232*b* covers an end portion of the upper and/or lower surfaces of the multipurpose tool in the region of the finger hole 206.

In some embodiments, the material of the sleeve 232 comprises at least one of plastic, soft rubber, hard rubber silicone, wood, or composite. The sleeve can have a textured or smooth surface.

In some embodiments, the sleeve 232 operates to provide an ergonomic feel for the user. The sleeve 232 may provide a slip-resistant gripping area during use, and during quick retrieval from a pocket or from storage. The sleeve 232 also provides for comfortable handling and reduction of possible skin irritation that may occur with repeated contact with the steel material of the tool 10*a*.

In some embodiments, the first portion 232*a* may be constructed and arranged to seat on the inner edge of the finger hole 206 and rotate freely within the finger hole 206. This is an especially attractive arrangement that permits the user to more readily spin the tool on a finger.

While embodiments have been described with respect to a certain specific embodiment, it will be appreciated that many modifications and changes may be made by those skilled in the art without departing from the spirit of the inventive concepts. It is intended, therefore, by the appended claims to cover all such modifications and changes as fall within the true spirit and scope of the inventive concepts.

In particular, with respect to the above description, it is to be realized that the optimum dimensional relationships for the parts of the present inventive concepts may include variations in size, materials, shape, form, function and manner of operation. The assembly and use of the present inventive concepts are deemed readily apparent and obvious to one skilled in the art.

What is claimed is:

1. A multifunctional hand-operable beverage service tool comprising:

a casing having a proximal end region and a distal end region;

a plurality of tools pivotally coupled to said casing, the tools each being independently pivotable relative to the casing along an arcuate path defined between retracted and deployed positions; wherein one of said plurality of tools comprises a wine key lever, the wine key lever comprising a zester at a distal end thereof, the zester including a plurality of openings, an outermost edge of the wine key lever including a sharpened surface proximal to the plurality of openings;

a first opening through the distal end region of the casing, the first opening being constructed and arranged to engage and remove a bottle cap; and a second opening comprising a finger hole through the proximal end region of the casing.

2. The multifunctional tool of claim 1 wherein the plurality of openings comprises a number ranging between two and eight.

3. The multifunctional tool of claim 1 wherein the plurality of openings comprises four openings.

4. The multifunctional tool of claim 1 wherein inner surfaces of the openings are oriented perpendicular to upper and lower surfaces of the wine key lever.

5. The multifunctional tool of claim 1 wherein inner surfaces of the openings are oriented at an acute angle relative to upper and lower surfaces of the wine key lever.

6. The multifunctional hand-operable tool of claim 1, wherein said wine key lever is constructed and arranged to comprise first and second leverage points that are fixed in position relative to each other.

7. The multifunctional tool of claim 1 wherein the finger hole comprises a rounded inner surface.

8. The multifunctional tool of claim 1 wherein the finger hole has an inner width of at least 1 inch.

9. The multifunctional tool of claim 1 wherein the finger hole is circular.

10. The multifunctional tool of claim 1 further comprising a sleeve on an inner surface of the finger hole.

11. The multifunctional tool of claim 10 wherein the sleeve is on an entire inner surface of the finger hole.

12. The multifunctional tool of claim 10 wherein the sleeve is on a portion of the inner surface of the finger hole.

13. The multifunctional tool of claim 10 wherein the sleeve further covers a portion of at least one of an upper surface or a lower surface of the casing proximal to the finger hole.

14. The multifunctional tool of claim 10 wherein the sleeve further covers an outermost end of the casing proximal to the finger hole.

15. The multifunctional tool of claim 10 wherein the sleeve is constructed and arranged to rotate freely relative to the casing.

16. A multifunctional hand-operable beverage service tool comprising:

a casing having a proximal end region and a distal end region;

a plurality of tools pivotally coupled to said casing, the tools each being independently pivotable relative to the casing along an arcuate path defined between retracted and deployed positions;

a first opening through the distal end region of the casing, the first opening being constructed and arranged to engage and remove a bottle cap; and a second opening comprising a finger hole through the proximal end region of the casing, a sleeve being positioned on an inner surface of the finger hole.

17. The multifunctional tool of claim 16 wherein the sleeve is on an entire inner surface of the finger hole or on a portion of the inner surface of the finger hole.

18. The multifunctional tool of claim 16 wherein the sleeve covers a portion of at least one of an upper surface or a lower surface of the casing proximal to the finger hole, or further covers an outermost end of the casing proximal to the finger hole.

19. The multifunctional tool of claim 16 wherein the sleeve is constructed and arranged to rotate freely relative to the casing.

20. The multifunctional tool of claim 16 wherein one of said plurality of tools comprises a wine key lever, the wine key lever comprising a zester at a distal end thereof, the zester including a plurality of openings, an outermost edge of the wine key lever including a sharpened surface proximal to the plurality of openings.

* * * * *